United States Patent [19]

Lossack et al.

[11] Patent Number: 4,476,911

[45] Date of Patent: Oct. 16, 1984

[54] DIECASTING METHOD FOR PRODUCING CAST PIECES WHICH ARE LOW IN GAS, PORES AND OXIDES, AS WELL AS DIECASTING MACHINE FOR IMPLEMENTING THE METHOD

[75] Inventors: Edgar Lossack, Bonn; Jochen Spriestersbach, Alfter; Josef Baur; Wilfried Schwab, both of Weingarten, all of Fed. Rep. of Germany

[73] Assignee: Maschinenfabrik Müller-Weingarten A.G., Weingarten, Fed. Rep. of Germany

[21] Appl. No.: 317,617

[22] Filed: Nov. 3, 1981

[30] Foreign Application Priority Data

Nov. 3, 1980 [DE] Fed. Rep. of Germany ..... 3041340

[51] Int. Cl.[3] ..... B22D 27/15

[52] U.S. Cl. ..... 164/65; 164/257; 164/305; 164/312

[58] Field of Search ..... 164/63, 65, 113, 133, 164/312, 119, 256, 257, 253, 254, 255, 258, 305, 120

[56] References Cited

U.S. PATENT DOCUMENTS

| | | | |
|---|---|---|---|
| 2,391,182 | 12/1945 | Misfeldt | 164/113 |
| 2,864,140 | 12/1958 | Morgenstern | 164/256 |
| 3,009,218 | 11/1961 | Rearwin | 164/257 |
| 3,019,495 | 2/1962 | Cornell | 164/256 X |
| 3,178,782 | 4/1965 | Bennett | 164/257 X |
| 3,283,372 | 11/1966 | Moorman et al. | 164/257 X |
| 4,146,081 | 3/1979 | Reis | 164/256 X |
| 4,311,185 | 1/1982 | Zimmerman | 164/312 X |
| 4,334,575 | 6/1982 | Miki et al. | 164/312 X |
| 4,420,028 | 12/1983 | Nelson | 164/312 X |

FOREIGN PATENT DOCUMENTS 43-28806 11/1968 Japan ..... 164/305

OTHER PUBLICATIONS

Kurt Bombe, "Das Vaskuumdruckgiessen in heutiger Sicht", Giesserei 62 (1975) No. 10, pp. 257–262.

Friedrich Georg Stummer, "Welche Probleme kann das Vakuumverfahren bei Aluminium-Druckgusslösen?", Giesserei 64 (1977) No. 9, 4/28, pp. 238–240.

Frommer/Lieby, Druckgiess-Technik, Band I, 1965, Springer-Verlag, New York, pp. 75–79 and 112, 113.

*Primary Examiner*—Nicholas P. Godici
*Assistant Examiner*—P. Weston Musselman, Jr.
*Attorney, Agent, or Firm*—Spencer & Frank

[57] ABSTRACT

A diecasting process for producing cast pieces for metals or their alloys by means of a horizontal cold chamber diecasting machine. The diecasting machine includes a diecasting mold held under a vacuum, a fill chamber coupled to the diecasting mold, a holding furnace containing metal melt, a suction pipe partially immersed in the holding furnace and coupled to the fill chamber, means for transporting metal melt from the holding furnace through the suction pipe into the fill chamber under a vacuum, and means for moving the metal melt from the fill chamber into the diecasting mold. During the dosaging phase when the fill chamber is filled with metal melt, gases and lubricant vapors are developed upon entry of the melt into the fill chamber. The process includes the steps of maintaining the vacuum in the fill chamber during the dosaging phase until the gases and lubricant vapors so developed have been substantially extracted and maintaining the vacuum in the fill chamber to its maximum extent until the diecasting mold is completely filled with the metal melt.

38 Claims, 3 Drawing Figures

DIECASTING METHOD FOR PRODUCING CAST PIECES WHICH ARE LOW IN GAS, PORES AND OXIDES, AS WELL AS DIECASTING MACHINE FOR IMPLEMENTING THE METHOD

BACKGROUND OF THE INVENTION

The invention relates to a diecasting method for producing cast pieces which are low in gas, pores and oxides, particularly cast pieces of 1–3 kg shot weight of metals or their alloys, such as aluminum and aluminum alloys or the like, by means of a preferably horizontal cold chamber diecasting machine of known design, with the metal being transported by means of a vacuum from the melting or holding device (holding furnace) into the fill chamber through a suction pipe, and the diecasting mold also being maintained under vacuum.

The diecasting process for aluminum is a very economical method of producing parts, even parts having complicated shapes, in but a few process steps.

However, cast pieces produced in conventional diecasting processes have structural regions which, as a result of the process, are loosened, porous and full of impurities, resulting in a lack of strength and bubble formation during heat treatments. The utilization of the characteristics attainable in aluminum cast materials by way of required heat treatment methods, such as, for example solution heat treatment, is not possible because of these phenomena.

To realize an improvement in quality, the so-called pore-free process has been developed (German Pat. No. 1,558,261). Here, a displacement gas, preferably oxygen, is introduced into the fill chamber and into the mold cavity and thus the air is displaced. Thereafter, the liquid aluminum is filled into the fill chamber and the turbulent interaction of the liquid aluminum with the oxygen produces a reaction to form aluminum oxide particles which are then present in the cast piece as dispersed solid particles. Although the cast pieces are heat treatable and of good quality, the process has the drawback that only lubricants which are free of mineral oil can be used since otherwise there would exist the danger of explosion during the filling phase. This fact produces difficulties in the distribution of the lubricant since inorganic solid lubricants are used with preference. The process steps of rinsing and applying the lubricant requires much time in the casting cycle so that the production output in this process is not very high. Moreover, cast pieces produced according to this process are distinguished by a high oxide content. With insufficient mold filling rates, there may occur fluctuations in the oxide distribution which adversely influence the quality of the cast pieces.

In order to realize increased yield of cast pieces, diecasting processes have been developed in which the metal melt is pulled into the fill chamber through a suction tube by means of a vacuum (DE-OS No. 1,458,151). In this case, a sufficient vacuum must exist during the mold filling phase and during the dosaging phase so that the hydrogen content of the melt and the air present in the mold cavity and in the fill chamber as well as the casting gases developed during contact with the liquid aluminum can be attracted. This process is directed toward reducing the oxide content in the cast pieces.

A further prior art process (Periodical Giesserei 64 (1977), No. 9, pages 236 et seq.) operates with a very short vacuum period of about 1.5 seconds. Although it is possible in this case to extract, for example, the air and the first casting gases, the period of dwell of the vacuum is not sufficient to perform sufficient degasification during the casting process. The result is that during the mold filling phase a considerable amount of gas and impurities are still enclosed in the cast pieces. As a consequence, the cast pieces produced according to this method cannot be heat treated at high temperatures since bubble formation will then be noted.

SUMMARY OF THE INVENTION

An object of the present invention is to develop a diecasting process and a diecasting machine that produces cast pieces which are of the quality of the already mentioned pore-free process while realizing a considerably greater productivity. It is a further object of the present invention to avoid the drawbacks of the known vacuum casting processes and additionally to reduce the oxide content in the cast pieces.

For this purpose, the present invention proposes, in a process of the above-described type, to maintain the vacuum during dosaging until such time that the lubricant vapors and gases developed during introduction of the melt into the fill chamber have been almost completely extracted. Moreover, it is here of advantage that when the melt enters into the fill chamber, an essentially laminar flow is maintained. The vacuum in the fill chamber is preferably maintained to its full extent until the mold filling phase is completed. A further feature of the invention is seen in that the suction capability of the vacuum system and the inflowing rate of the melt are adapted to one another in such a way that most of the air and the lubricant vapors are extracted from the fill chamber before the major quantity of the melt enters the fill chamber. It is additionally of advantage for the period of dwell of the vacuum, comprising the dosaging period and the mold filling phase, to be maintained for at least three seconds.

A particular embodiment of the process according to the invention is characterized in that, if aluminum alloys based on aluminum-silicon, aluminum-silicon-magnesium and aluminum-silicon-copper or similar alloys of customary viscosity are used for the metal melt (a) approximately 0.40 to 0.55 kg of metal melt per second are fed into the fill chamber through the suction pipe from the beginning of vacuum build-up to the actuation of the casting charge; and (b) the average flow rate of the melt at the smallest cross section (nozzle) of the suction pipe is approximately 6.5 to 8.0 m/sec, with (c) the values of a and b being based on a nozzle having a diameter of 6 mm.

In connection with this, the following statements can be made:

If the metal melt is introduced slowly at values below 0.40 kg/sec, there exists the danger of partial freezing of the melt. This produces slate wafers of hardened melt which are ejected ahead of the melt front and cover part of the lubricating film so that the latter cannot evaporate. In this way, unevaporated lubricant parts may be included in the melt during advancement of the casting piston, thus causing the occurrence of the drawbacks mentioned in the introduction to the specification.

With higher feed rates for the metal melt at values above 0.55 kg/sec there exists the danger of turbulence formation or turbulent travel of the lubricant vapors and lubricant gases. These may thus enter into the melt and there produce the stated disadvantageous effects.

Moreover, if the metal melt is introduced rapidly, the time for extraction of the lubricant gases is too short. Although the further supply of metal melt can be stopped by advancing the casting piston (piston stop) and the vacuum can simultaneously be maintained to further degas the melt, this mode of operation has the disadvantageous effect that the sudden acceleration of the piston may produce "spill-over" of the melt and simultaneously bring part of the melt into the mold.

The stated limits in the data regarding the flow rate of the melt have a similar effect at the smallest cross section of the suction pipe. Dropping the flow rate below the lower limit leads to freezing in the suction pipe and even additional heating is no longer sufficient if values less than 6.5 m/sec are reached. With higher flow rates of more than 8.0 m/sec, the pressure loss in the suction pipe becomes very high and turbulence formation at the point of connection of the suction pipe with the fill chamber leads to disadvantageous effects.

A modification of the process provides that with use of alloys having a lower viscosity than the aluminum alloys referred to above (a) approximately 0.35 to 0.45 kg of metal melt per second is fed into the fill chamber through the suction pipe from the beginning of vacuum build-up until the actuation of the casting charge; and (b) the average flow rate of the melt at the smallest cross section (nozzle) of the suction pipe is about 6.0 to 7.0 m/sec, with (c) the values for a and b being based on a nozzle having a diameter of 6 mm.

Finally, the invention further proposes that with the use of alloys having a greater viscosity than the aluminum alloys referred to above (a) approximately 0.50 to 0.60 kg metal melt per second are fed into the fill chamber through the suction pipe from the beginning of vacuum build-up until the actuation of the casting charge; and (b) the average flow rate of the melt at the smallest cross section (nozzle) of the suction pipe is about 8.0 to 9.0 m/sec; with (c) the values for a and b being based on a nozzle having a diameter of 6 mm.

If a nozzle is used which has a cross section less that 6 mm, the previously fed in values for the dosaging quantity change to smaller values while the values for the flow rate increase. The values change inversely when the nozzle cross section is enlarged.

A further process step according to the invention is seen in that the holding temperature of the metal melt in the holding furnace lies at least 50° C. above the liquidus temperature. In addition, the invention proposes that while flowing through the suction pipe the liquid metal is subjected in a known manner to the influx of additional heat, for example by means of an inductive heating system.

One advantage of the cast pieces produced according to the invention is in that they are of such quality that thermal treatments are possible at temperatures as required for solution heat treatment of aluminum materials. Because of this heat treatment measure, the cast pieces produced by this process have high mechanical properties and can be subjected without difficulty to surface refinement. There is no reason not to apply surface refinement treatments such as anodizing, PTFE and enamel coatings.

Additionally, this casting process permits any possible selection of caster setting in dependence on the mold fill level. Corresponding to the geometry of the cast piece, the mold may be filled rapidly or slowly. Moreover, the period of dwell of the vacuum can be additionally extended within appropriate limits once the dosaging process is completed. It is quite important that this process does not require the use of solid, mineral oil free piston lubricants and mold release agents.

Several novel structural features are also proposed with respect to the apparatus for implementing the process according to the invention.

For example, there is provided, in addition to the vacuum connection for the mold, a further vacuum connection, which although known in connection with vertical diecasting machines, is novel relative to horizontal diecasting machines. According to the present invention this additional vacuum connection is preferably provided in the fill chamber in the region of the casting piston. Because of this additional vacuum connection, the vacuum build-up period in the fill chamber is reduced and so is the vacuum build-up period during the dosaging period. Simultaneously, the placement of the vacuum extraction orifice behind the piston and opposite the mold-side vacuum connection assures uniform formation of the liquid metal melt in the fill chamber.

A special embodiment according to the invention of this additional vacuum connection is characterized in that, by means of a bore in the piston rod, this connection is brought into the region of the casting piston to there exit from the casting piston. This affords an opportunity to maintain the vacuum in the fill chamber even after the piston has begun to move.

There is also the additional advantage that the vacuum valve for the further vacuum connection can be actuated before the two mold halves are joined. In this way there is prevented, during the mold closing process, a sudden backup within the fill chamber and thus within the suction pipe which would have an effect on the melt.

It is further proposed to adapt the velocity of the metal melt, when it moves from the holding furnace into the suction pipe, to the respective conditions by providing an exchangeable choke. This exchangeable choke not only effects precise dosaging of the metal but also serves the purpose of maintaining the period of contact of the liquid aluminum melt with respect to the vacuum over the longest possible time.

Preferably the choke is disposed in the lower end region of the suction pipe so as to prevent higher flow rates in the region of the fill chamber inlet since this would lead to wash-outs in the fill chamber. Moreover, the choke is preferably made of a wear resistant, refractory material with the nozzle region of the choke possibly being given different lengths. In this way it becomes possible to set the respectively required dosaging periods even more accurately and uniformly.

It is likewise possible to provide filter material in the suction pipe instead of a choke.

It is furthermore of advantage for the suction pipe to be equipped with a heating device. This may preferably be designed as an inductive heating device or a gas heating device and extends, according to the invention, into the upper connection region of the suction pipe. Such a heating device assures perfect flow of the metal melt through the suction pipe and prevents, even after longer periods of production, the so-called "freezing shut" of the suction pipe. Moreover, the heating device can be used to influence the viscosity of the metal melt after the melt has left the holding furnace.

A particularly valuable feature of the invention is considered to be the fact that the suction pipe is suspended in the fill chamber by means of a clamp and this clamp preferably acts on the fill chamber by means of spring bolts. Such a resilient suspension can produce an optimum seal in the transition between the suction pipe and the fill chamber, as such thermal influence results in different expansion conditions which can be compensated by this resilient suspension.

It is additionally an advantage that the casting piston is equipped with a known regulatable piston cooling system. Such a cooling system assures minimum piston play and thus suppresses the creation of streaks between the piston and the fill chamber.

It is further proposed according to the invention that the holding furnace is made adjustable in height. In this way, it is possible, for example, by simply lowering the holding furnace, to easily and quickly exchange the suction pipe. At the same time it is possible to adapt the system to the changing height of the melt in the holding furnace.

It is also of advantage, according to the invention, that the frontal face of the casting piston is provided with a conical suction end whose large diameter is smaller than the diameter of the casting piston. With this configuration of the casting piston, the metal melt is diverted into the longitudinal direction of the fill chamber when it enters the fill chamber. This prevents turbulence formations at the interior walls of the chamber.

The rear region of the fill chamber is lined, according to the invention, with a known heat-resistant sealing material, such as asbestos with graphite, to also prevent access of outside air during the vacuum suction process even at high fill chamber temperatures.

According to the invention, the interior walls of the suction pipe are lined with a refractory insulating mass or the suction pipe is produced of such a mass which is preferably chemically inert and designed to have a lower wettability with respect to aluminum alloys. This refractory lining of the suction pipe assures long service life for the suction pipe. Moreover, the chemical stability and the low wettability prevent reductions in the cross section during the casting process.

A further feature of the invention resides in the fact that the vacuum connection for the mold is preferably connected to the mold engraving above the gate system. Since during filling of the mold, the metal melt is able to react with components still present in the mold, the resulting vapors and gases are extracted through the vacuum line connected to the mold engraving above the gate system.

It has moreover been found that the nozzle cross section of the choke should preferably have a diameter of 4 to 8 mm.

It is likewise of advantage, according to the invention, for the holding furnace to be disposed below the fill chamber between the fixed clamping plate and the casting piston.

DESCRIPTION OF THE PREFERRED EMBODIMENTS

Figure 1:
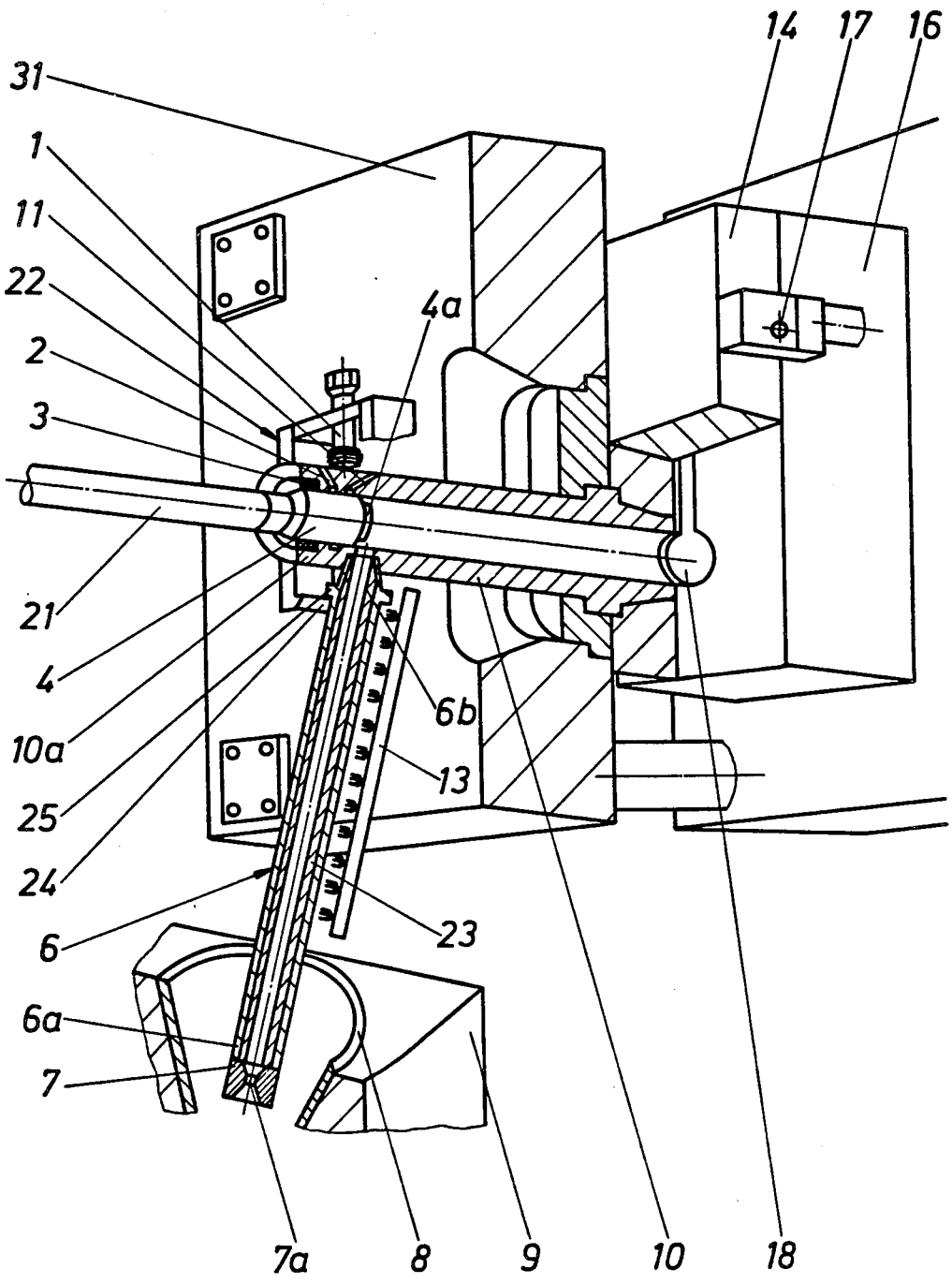
FIG. 1 shows a perspective view, partially in section, of the diecasting machine according to the invention.

FIG. 1 shows essentially only the region of the fixed clamping plate 31 with the fixed mold half 14 and the movable mold half 16 of the diecasting machine. To better illustrate the region of the fill chamber 10, the fixed clamping plate 31, the fixed mold half 14, the fill chamber 10, the actual suction pipe 6 and the holding furnace 9 with its melting crucible 8 are shown partially cut open. Reference numeral 17 indicates the valve for connecting the vacuum to the mold.

Figure 3:
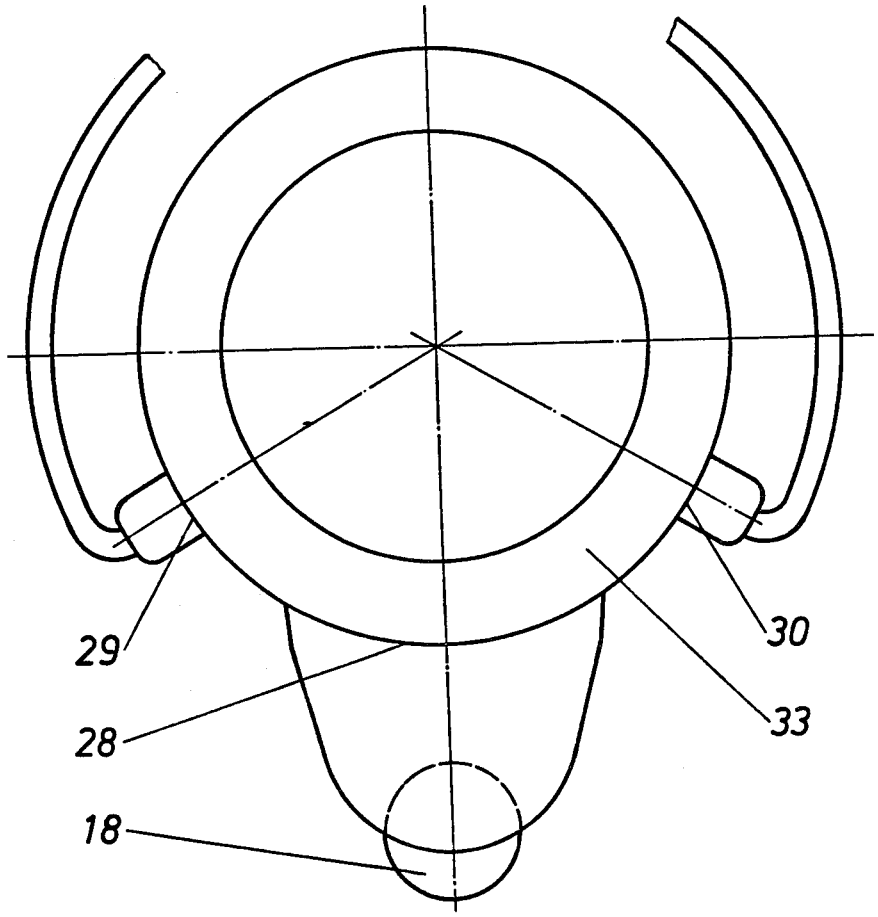
FIG. 3 shows the position of the vacuum connections in the region of the gate section of the mold engraving with the aid of a cast piece.

The vacuum lines ending within the mold lie above the gate section. This is better illustrated in FIG. 3 which shows a cast piece, for example a pan, with the gate region being marked 28 and the two vacuum connections 29 and 30. The casting flow bears the numeral 18:

Referring again to FIG. 1, the front vacuum connection in the region of the casting piston 4 is marked 2. In this region, there also ends a connection 11 for piston lubrication. A conical projection **4*a* is provided at the frontal face of the casting piston 4. In this way, the metal entering the fill chamber 10 from the suction pipe 6 is deflected toward the longitudinal axis of the fill chamber 10, thus preventing turbulence formation. The rear region 10*a* of the fill chamber 10 is lined with a heat resistant sealing material 3. The suction pipe 6 is hung by means of a clamp 22. This clamp 22 has a lower hook-shaped tongue 24 which passes underneath an annular flange 25 on the suction pipe 6. From the top, a spring bolt 1 is brought through the clamp 22. This produces an elastic clamping of the conical end 6*b* of suction pipe 6 within the corresponding conical connection at the fill chamber 10**.

The reference numeral 23 identifies the insulating lining of the suction pipe 6 which is chemically inert and is designed to have low wettability with respect to aluminum alloys. The suction pipe 6 is heated by a heating system 13 which in the illustrated embodiment is indicated as a gas heating system. Instead of the gas heating system, an inductive heating system can also be used with preference, it being important that the heating system extends into the upper connecting region containing conical end **6*b* toward the fill chamber 10. The holding furnace 9** is designed to be adjustable in height, which, for the sake of simplicity is not shown separately.

Thus, the desired immersion depth of the suction pipe 6 in the metal melt can always be assured. Likewise, to facilitate removal or exchange of the suction pipe 6, the holding furnace 9 can be lowered and removed toward the side.

The reference numeral 7 indicates the choke of the suction pipe 6. The actual nozzle cross section **7*a*** as well as the length of the nozzle regions may here be of different design. Instead of the nozzle, a known filter material can also be used.

Figure 2:
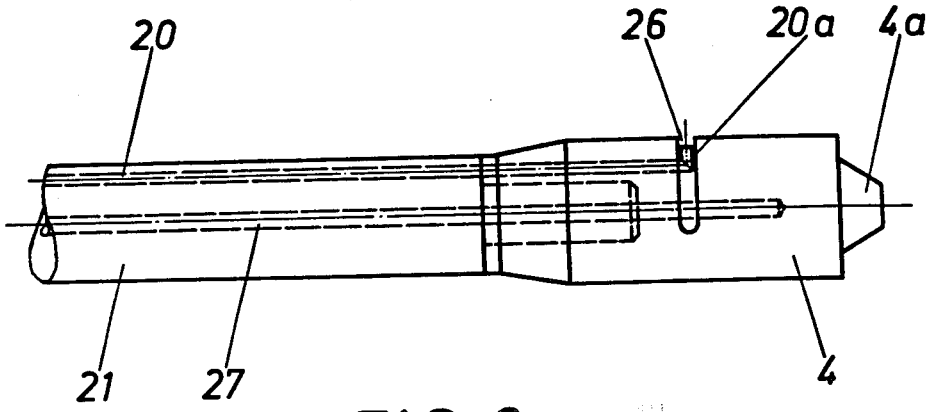
FIG. 2 shows in elevation a detail of an alternative design of the piston rod with casting piston for use in a diecasting machine of the type shown in FIG. 1.

FIG. 2 is a detail view of a piston rod 21 with casting piston 4. The reference numeral 27 indicates the bore of a known piston cooling device. The actual suction channel 20 for the vacuum is brought through the piston rod 21 and ends with its end region **20*a* in an annular channel 26. This embodiment has the advantage, compared to the design of FIG. 1, that the vacuum can be maintained at the casting piston 4 even during the forward movement of the casting piston 4**.

We claim:

1. A diecasting process for producing cast pieces from metals or their alloys by means of a horizontal cold chamber diecasting machine including a diecasting mold held under a vacuum, a fill chamber coupled to the diecasting mold, a holding furnace containing metal melt, a suction pipe partially immersed in the holding furnace and coupled to the fill chamber, vacuum means for transporting metal melt from the holding furnace through the suction pipe into the fill chamber under a vacuum, a casting piston for moving the metal melt from the fill chamber into the diecasting mold, and a piston rod attached to the casting piston for moving the casting piston, whereby the filling of the fill chamber with metal melt constitutes a dosaging phase and during the dosaging phase gases and lubricant vapors are developed during entry of the melt into the fill chamber, said process comprising the steps of:

providing the casting piston with an annular channel and the piston rod and casting piston with a longitudinal bore which extends from the piston rod into the casting piston and there exits into the annular channel;

connecting the longitudinal bore in the piston rod to a source of vacuum for creating a vacuum at the annular channel in the casting piston; and maintaining a vacuum at the annular channel in the casting piston so as to cooperate with the vacuum in the mold for extracting gases and lubricant vapors from the fill chamber.

2. A diecasting process according to claim 1, further including the step of maintaining an essentially laminar flow of the metal melt during its entry into the fill chamber.

3. A diecasting process according to claim 1, wherein the fill chamber contains air, and further comprising the step of adjusting the suction of the vacuum and the rate of flow of the melt through the suction pipe so that a major portion of the air and lubricant vapors are extracted from the fill chamber before a major quantity of metal melt enters the fill chamber.

4. A diecasting process according to claim 1, wherein the vacuum in the fill chamber has a dwell time comprising the entirety of the dosaging phase and the time required to fill the diecasting mold, and the dwell time is at least 3 seconds.

5. A diecasting process according to claim 1, wherein the suction pipe has a nozzle, and the metal melt comprises an aluminum alloy based on aluminum-silicon, aluminum-silicon-magnesium and aluminum-silicon-copper or an alloy having a similar magnitude of viscosity, and said process further comprises the steps of:

feeding approximately 0.40 to 0.55 kg of metal melt per second into the fill chamber through the suction pipe from beginning of vacuum build-up until moving the contents of the fill chamber into the diecasting mold; and providing an average flow rate of the metal melt at the smallest cross section of the nozzle of the suction pipe at approximately 6.5 to 8.0 m/sec, the values for said feeding and providing steps being based on a nozzle having diameter of 6 mm.

6. A diecasting process according to claim 1, wherein the suction pipe has a nozzle, and the metal melt comprises an alloy having a lower viscosity than the viscosity of aluminum alloys based on aluminum-silicon, aluminum-silicon-magnesium or aluminum-silicon-copper and, said process further comprises the steps of:

feeding approximately 0.35 to 0.45 kg metal melt per second into the fill chamber through the suction pipe from the beginning of vacuum build-up until moving the contents of the fill chamber into the diecasting mold; and providing an average flow rate of the melt at the smallest cross section of the nozzle of the suction pipe at approximately 6.0 to 7.0 m/sec, the values for said feeding and providing step being based on a nozzle having a diameter of 6 mm.

7. A diecasting process according to claim 1, wherein the suction pipe has a nozzle, and the metal melt comprises an alloy having a greater viscosity than the customary viscosity of aluminum alloys based on aluminum-silicon, aluminum-silicon-magnesium, or aluminum-silicon-copper, and said process further comprises the steps of:

feeding approximately 0.50 to 0.60 kg of the metal melt per second into the fill chamber through the suction pipe from the beginning of vacuum build-up until moving the contents of the fill chamber into the diecasting mold; and providing an average flow rate of the metal melt at the smallest cross section of the nozzle of the suction pipe at approximately 8.0 to 9.0 m/sec, the values for said feeding and providing steps being based on a nozzle diameter of 6 mm.

8. A diecasting process according to claim 1, further including the step of holding the temperature of the metal melt in the holding furnace at least 50° C. above the liquidus temperature.

9. A diecasting process according to claim 1, further including providing a heating means adjacent the suction pipe and subjecting the liquid metal melt to an additional heat influx during its flow through the suction pipe.

10. A diecasting process according to claim 9, wherein the heating means is an inductive heating system.

11. A diecasting process according to claim 1, including regulating the speed of the metal melt when it passes from the holding furnace into the suction pipe.

12. A diecasting process according to claim 11, wherein said regulating step includes disposing an exchangeable choke made of a wear resistant, refractory material at the end of the suction pipe immersed in the holding furnace.

13. A diecasting process according to claim 1, wherein said maintaining step includes maintaining the vacuum at the annular channel during the dosaging phase and after the casting piston has begun to move.

14. A horizontal cold chamber diecasting machine for producing cast pieces from metal melt comprising:

a diecasting mold having a first vacuum connection for connection to a vacuum means;

a fill chamber having first and second ends opposite each other with said first end being coupled to said diecasting mold, said fill chamber being provided with a second vacuum connection for connection to a vacuum means;

a holding furnace for holding the metal melt;

a suction pipe partially immersed in said holding furnace and connected to said fill chamber for transporting the metal melt from said holding furnace into said fill chamber; and means for moving the metal melt from said fill chamber into said diecasting mold, said moving means including a casting piston provided with an annular channel and disposed in said fill chamber, and a piston rod connected to said casting piston, said piston rod being provided with a longitudinal bore which extends into said casting piston and there exits into said annular channel, said annular channel comprising said second vacuum connection wherein a vacuum maintained at said annular channel can cooperate with a vacuum maintained in said mold for extracting gases and lubricant vapors from said fill chamber.

15. A diecasting machine according to claim 14, wherein said said casting piston is provided with cooling means.

16. A diecasting machine according to claim 14 wherein said casting piston has a diameter and a frontal face at which a frustoconical projection is provided, the large diameter of said frustoconical projection being smaller than the diameter of said casting piston.

17. A diecasting machine according to claim 14, wherein said diecasting mold comprises two mold halves, at least one of which is mounted to be brought together with the other mold half, and further comprising a vacuum valve connected to said second vacuum connection for actuation before said two mold halves are brought together.

18. A diecasting machine according to claim 14, wherein said suction pipe includes an exchangeable choke for controlling the velocity of the metal melt when it is transported from said holding furnace through said suction pipe into said fill chamber.

19. A diecasting machine according to claim 18, wherein said suction pipe has a lower end region and said choke is disposed in said lower end region.

20. A diecasting machine according to claim 18 or 19, wherein said choke comprises a wear-resistant, refractory material.

21. A diecasting machine according to claim 19, wherein said choke has a nozzle region of selected length.

22. A diecasting machine according to claim 18, wherein said choke has an opening having a diameter from 4 to 8 mm.

23. A diecasting machine according to claim 14, further comprising filter material disposed in said suction pipe.

24. A diecasting machine according to claim 14, further comprising a heating device for heating said suction pipe.

25. A diecasting machine according to claim 24, wherein said heating device is an induction heating device.

26. A diecasting machine according to claim 24, wherein said heating device is a gas heating device.

27. A diecasting machine according to claim 24, wherein said suction pipe has an upper region adjacent said fill chamber and said heating device is adjacent said suction pipe along said upper region.

28. A diecasting machine according to claim 14, further comprising a clamp means for hanging said suction pipe from said fill chamber.

29. A diecasting machine according to claim 28, wherein said clamp means includes at least one spring bolt acting against the fill chamber.

30. A diecasting machine according to claim 14, wherein said holding furnace is adjustable relative to said suction pipe.

31. A diecasting machine according to claim 14, wherein said second end of the fill chamber is made of heat-resistant sealing material.

32. A diecasting machine according to claim 31, wherein said heat-resistant sealing material is asbestos.

33. A diecasting machine according to claim 31, wherein said heat-resistant sealing material is graphite.

34. A diecasting machine according to claim 14, wherein said suction pipe has inner walls lined with a refractory insulating mass.

35. A diecasting machine according to claim 14, wherein said suction pipe is made of refractory insulation mass.

36. A diecasting machine according to claim 34 or 35, wherein said insulating mass is chemically inert and has a low wettability with respect to aluminum alloys.

37. A diecasting machine according to claim 14, wherein said diecasting mold has a mold engraving and a gate system for entry of the metal melt into said mold engraving, and said first vacuum connection is connected to said mold engraving above said gate system.

38. A diecasting machine according to claim 14, wherein said moving means further comprises a casting piston drive coupled to said casting piston, and further comprising a fixed clamping plate mounting said fill chamber, said holding furnace being disposed below said fill chamber between said fixed clamping plate and said casting piston drive.

* * * * *

UNITED STATES PATENT AND TRADEMARK OFFICE

CERTIFICATE OF CORRECTION

PATENT NO. : 4,476,911

DATED : October 16th, 1984

INVENTOR(S) : Edgar Lossack et al

It is certified that error appears in the above-identified patent and that said Letters Patent is hereby corrected as shown below:

In the heading of the patent, under [73] Assignee data, after "Germany", insert --and Vereinigte Aluminium-Werke AG, Weingarten, Fed. Rep. of Germany--.

Signed and Sealed this

*Fifteenth* Day of *October 1985*

[SEAL]

*Attest:*

*Attesting Officer*

DONALD J. QUIGG

*Commissioner of Patents and Trademarks—Designate*